United States Patent [19]

Vlad

[11] Patent Number: 4,967,429

[45] Date of Patent: Nov. 6, 1990

[54] SLOT FIN PILLOW

[76] Inventor: Marianne Vlad, 210 Pembrook Dr., Yonkers, N.Y. 10710

[21] Appl. No.: 484,399

[22] Filed: Feb. 23, 1990

Related U.S. Application Data

[63] Continuation-in-part of Ser. No. 328,955, Mar. 27, 1989, abandoned.

[51] Int. Cl.[5] ..... A47G 9/00; A47C 7/38

[52] U.S. Cl. ..... 5/434; 5/437; 297/397

[58] Field of Search ..... 5/434, 436, 437, 443; 297/391, 397, 404, 253, 284

[56] References Cited

U.S. PATENT DOCUMENTS

| | | | |
|---|---|---|---|
| 2,234,072 | 3/1941 | Braff | 5/434 |
| 2,591,306 | 4/1952 | Smerman | 297/397 |
| 2,803,836 | 8/1957 | Hunsicker | 5/484 |
| 3,195,953 | 7/1965 | Zacks | 297/397 |
| 3,220,770 | 11/1965 | Schaeffer | 5/434 |
| 3,426,372 | 2/1969 | Enelow | 5/434 |
| 4,047,757 | 9/1977 | Eames et al. | 297/253 |

FOREIGN PATENT DOCUMENTS

| | | | |
|---|---|---|---|
| 558402 | 1/1944 | Austria | 27/72.5 |
| 1335826 | 7/1963 | France | 297/397 |
| 2545710 | 11/1984 | France | 5/434 |

*Primary Examiner*—Alexander Grosz

*Attorney, Agent, or Firm*—Davis, Hoxie, Faithfull & Hapgood

[57] ABSTRACT

A slot fin pillow that may be adjustably and securely positioned on a supporting surface comprising a pillow and a self-supporting fin extending from a portion of the pillow for insertion into a slot in a supporting surface.

7 Claims, 1 Drawing Sheet

SLOT FIN PILLOW

The present application is a continuation-in-part of U.S.S.N. 07/328,955, filed on Mar. 27, 1989, now abandoned.

BACKGROUND OF THE INVENTION

This invention relates to a pillow or supplement backrest that may be adjustably positioned on a supporting surface. More particularly, the pillow or backrest may be adjustably positioned through the interfit of an extending fin member on the pillow and a receiving slot on the supporting member.

Passengers in automobiles, buses, trains and airplanes use pillows to provide comfort and support for the head or lower back. The position of the pillow often needs adjustment as the passenger changes position. Upon any movement by the passenger, however, the pillow often dislodges from its desired position. Therefore, it would be advantageous for the pillow to remain secured to a supporting surface, while remaining adjustable for comfort.

SUMMARY OF THE INVENTION

In the present invention, a pillow is affixed to a self-supporting fin, which can be inserted into a slot in a supporting surface, such as a car seat. The fin can be firm and elastic, or rigid. The fin has a size and shape adapted to releasably, frictionally anchor the pillow in the slot. The fin is preferably hingedly attached to the casing of the pillow, to enable movement of the pillow while the fin is secured. The fin is also preferably centrally located opposite the body supporting surface of the pillow, to distribute the pressure on the fin and pillow uniformly. The fin can also have markings or grooves to further improve its frictional engagement with the slot. A plurality of pillows can be placed in a row either vertically, horizontally or in any other fashion so as to provide an entire row of comfort and protection for the individual. The pillow can also be disposable.

DESCRIPTION OF THE INVENTION

Figure 1:
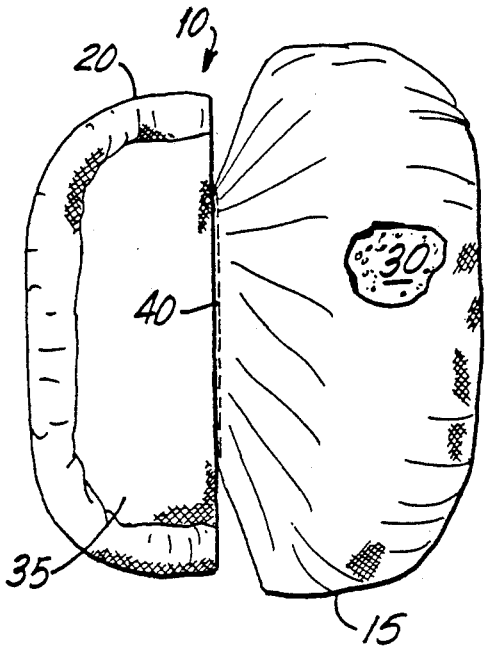
FIG. 1 is a side view of the pillow of the present invention.
Figure 2:
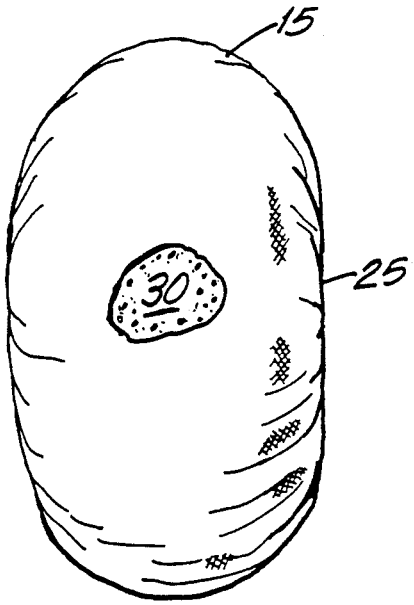
FIG. 2 is a front view of the pillow of the invention.

The pillow 10 of the present invention, as shown in FIGS. 1 and 2, is comprised of a pillow portion 15 and a self-supporting fin portion 20. The pillow 15 may be of oval shape as viewed from a side-view and can be comprised of an outer casing 25 containing a compressible material 30. The compressible material may be polyurethane foam, polyester fiber, foam rubber or down, for example. A polyester fiber is preferred.

The pillow portion 15 is hingedly attached to the fin 20 along a seam 40, enabling the rotation of the pillow about the fin. The fin is adapted to releasably, frictionally anchor the pillow in the slot in a supporting surface, such as a car seat. The fin 20 is typically made of plastic, rubber, or some other self-gripping material to reduce slippage upon insertion into a slot or opening. It may be covered with fabric such as the material forming the pillow casing.

Figure 3:
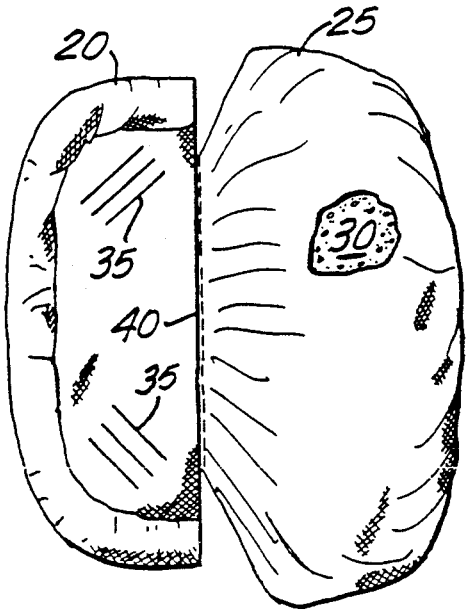
FIG. 3 is a side view of another embodiment of the fin of the present invention.

To enable the easy insertion of the fin, the fin needs to be self-supporting, essentially maintaining its shape upon insertion into a slot. The fin does not compress or fold over upon itself on insertion. The fin can therefore be inserted in a single motion, without undue manipulation of the slot itself. Preferably, the fin is firm and slightly pliable, enabling the fin to follow the contours of the slot, which may be curved. It may also be rigid. Preferably, the fin is also essentially flat. As shown in FIG. 3, the fin can also have friction enhancing means, such as grooves 35, which increase the frictional engagement with the slot.

The fin is attached substantially centrally to the surface opposite the body resting surface, distributing the pressures on the fin and pillow uniformly. This reduces disalignment of the pillow in use.

In a preferred embodiment, the fabric of the outer casing 25 extends into the fin 20, through the seam 40. This seam provides the hinge that enables the pillow to swing freely in either direction against the opposite sides of the fin. The hinge assists in avoiding tearing at the seam, as well as allowing for the easy adjustment of the pillow while the fin is secured in the slot.

A disposable version of the pillow 10 can also be made, wherein the outer casing 25 is a paper-mesh-like material and the fin 20 can be stiff paper, such as cardboard. The stuffing or compressible material would also be made of an inexpensive material. The disposable pillow can be used commercially in planes, trains, buses and automobiles. The seats in these forms of transportation may require an adapter, such as a strap or pocket to accept the placement of the fin 20. The disposable pillow could also be used in hospitals for use on elevated beds.

Figure 4:
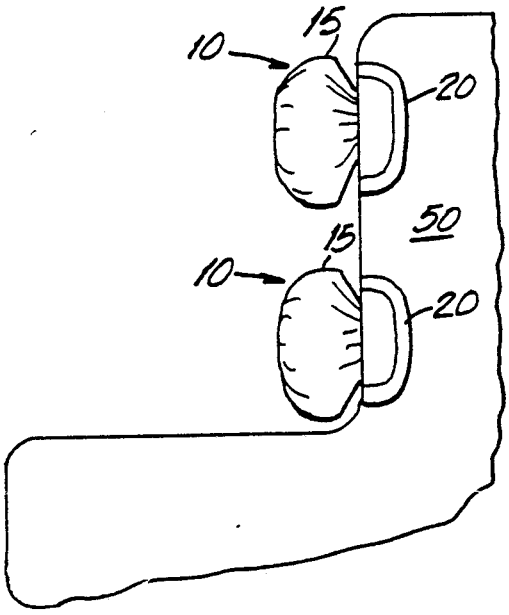
FIG. 4 is a cross-sectional view of a slot in a car seat, with two pillows of the present invention in position.

FIG. 4 shows the pillow 10 inserted vertically into a slot or opening in a car seat 50. The slot is shown in cross-section. The pillow can be placed in any number of positions or in the backrest of the seat depending upon where openings are present.

What is claimed is:

1. A slot fin pillow comprising a pillow and an essentially rigid fin extending from a portion of the surface of the pillow, said fin adapted to releasably, frictionally anchor the pillow within a receiving slot in a supporting surface.

2. The pillow of claim 1, wherein the fin is hingedly connected to the pillow such that the pillow is free to rotate against each opposing surface of the fin.

3. The pillow of claims 1 or 2, wherein the fin is essentially flat.

4. The pillow of claims 1 or 2, wherein the fin is attached to the pillow substantially centrally on the surface of the pillow opposite the surface contiguous to the body resting surface.

5. The pillow of claim 4, wherein friction producing means are disposed on the fin surfaces.

6. The pillow of claim 1, wherein friction enhancing means are disposed on the fin surfaces.

7. A slot fin pillow comprising an outer casing filled with a compressible material and an essentially flat, essentially rigid fin hingedly connected to said casing, said fin having a size and shape adapted to releasably, frictionally anchor the pillow in a slot in a supporting surface.

* * * * *